US005478067A

United States Patent [19]

Requena et al.

[11] Patent Number: 5,478,067

[45] Date of Patent: Dec. 26, 1995

[54] DEVICE FOR INTRODUCING SHEETS

[75] Inventors: Marcelino Requena; Bernard Gamper; Giuseppe Bortolotti, all of Yverdon-Les-Bains, Switzerland

[73] Assignee: OCD S.A., Yverdon-Les-Bains, Switzerland

[21] Appl. No.: 271,624

[22] Filed: Jul. 7, 1994

[30] Foreign Application Priority Data

Sep. 10, 1993 [CH] Switzerland ..... 2735/93

[51] Int. Cl.[6] ..... B65H 5/22

[52] U.S. Cl. ..... 271/3.14; 271/10.12; 271/114; 271/226; 271/241

[58] Field of Search ..... 271/4.1, 3, 4, 10, 271/114, 117, 118, 121, 126, 241, 226, 3.14, 4.01, 10.01, 10.11, 10.12; 400/630, 625, 636, 645, 579

[56] References Cited

U.S. PATENT DOCUMENTS 4,211,499 7/1980 Hunt et al. .
4,556,209 12/1985 Tsubo ..... 271/10
4,795,145 1/1989 Fuller ..... 271/10
4,986,525 1/1991 Takagi et al. ..... 271/10 X

FOREIGN PATENT DOCUMENTS 0017286 10/1980 European Pat. Off. .
0464815 1/1992 European Pat. Off. .
2401778 3/1979 France .
59-102739 6/1984 Japan ..... 271/10
1584606 2/1981 United Kingdom .

*Primary Examiner*—David H. Bollinger
*Attorney, Agent, or Firm*—Young & Thompson

[57] ABSTRACT

The device includes an introduction channel (51) into which the sheets are stacked on a support (52). During the selection of the top sheet (53*a*), urging members (66) urge the sheets (53) against driving rollers (11) which convey the top sheet until its front edge comes in contact with a fixed alignment stop (67). After the alignment of the sheet, deflector elements (68) bring the front edge to the driving rollers (11) in such a manner that the sheet comes in contact with the periphery of these rollers (11) to be driven until it faces the printing head. A selection and a conveying of the sheets are thus achieved which are reliable, as well as an accurate alignment, while reducing the space needed for the device.

13 Claims, 6 Drawing Sheets

DEVICE FOR INTRODUCING SHEETS

FIELD OF THE INVENTION

The present invention is concerned with a device for introducing sheets into printers or typewriters, comprising an introduction channel for the sheets, exhibiting a support designed for retaining a stack of sheets and driving rollers arranged on a driving shaft so as to move the top sheet of the stack and bring it to face a printing head.

BACKGROUND OF THE INVENTION

Such introduction devices for sheets of paper are known for use in printers, in typewriters or in other apparatuses such as photocopying machines. These known devices use a series of introduction rollers of an appreciable diameter which are associated with the printer cylinder for obtaining a good alignment of the sheet of paper at its introduction.

Recently, it has become important to develop printers or typewriters of a very small size, of the so-called portable type. The devices for introducing paper of these printers had necessarily to be reduced in size. Instead of a series of introduction rollers associated with the printer roller, attempts have been made at using solely a cylinder of a small diameter, which however resulted in a poor alignment of the sheet inside the printer.

SUMMARY OF THE INVENTION

The present invention is aimed at remedying the above-mentioned drawbacks and at providing an introduction device of a small size ensuring an accurate alignment of the sheet introduced into the printer.

To this end, the invention is characterized in that the introduction device includes a fixed alignment stop arranged downstream of the introduction channel, so that the top sheet be urged in a first step by driving rollers with its front edge against said alignment stop and at least one movable deflector designed for cooperating with this top sheet, to remove in a second step its front edge from the alignment stop and forward this edge to the driving rollers so that the top sheet comes into contact with the periphery of the driving rollers.

This arrangement ensures a very good alignment of the paper, while requiring little space, in particular because of the small diameter of the driving rollers forming the cylinder. This advantage is particularly important for the so-called portable printers.

Advantageously, the device includes movable retractable guiding elements arranged in said introduction channel, facing the support so as to direct the sheets inside the retaining corners of this support upon insertion of a stack of sheets into the introduction channel.

This construction makes it possible, even when an introduction channel and a fixed paper support are present, to insert easily and reliably the stack of sheets of paper into the channel.

Preferably, the support is provided with movable support members which are designed to urge the sheets against the driving rollers when the top sheet of the stack must be selected to be brought to face the printing head.

This arrangement makes possible an accurate control of the selection of the paper.

According to one version which is advantageous, the device includes movable retractable loading stops arranged in the vicinity of said support and driven in such a manner as to protrude into the introduction channel for retaining a stack of sheets at its insertion into the channel and to retract during the travel of the top sheet towards the printing head.

These stops have the advantage that they retain satisfactorily the stack of sheets during its introduction, even if the conventional lateral support guides of the sheets are set too far apart or if the sheets are too narrow.

In a preferred embodiment, the device includes a control shaft lying parallel to the driving shaft of the rollers and including first cams designed for controlling the movement of the movable deflector element.

An accurate control is thus obtained of the movement of the deflector element.

Advantageously, the driving shaft of the rollers and the control shaft are connected to a single motor capable of rotation in both directions, the driving shaft being provided with a unidirectional coupling arranged so as to be engaged with the motor in a first direction of rotation of this motor and the control shaft being provided with a second unidirectional coupling arranged in such a manner as to be engaged with the motor in the second direction of rotation of this motor. This construction needs very little space and is cheap to manufacture.

According to a mode which is particularly advantageous, the control shaft further includes second and third cams arranged in such a manner as to control the forward movement of the movable guiding elements and of the movable loading stops, respectively, into the introduction channel for facilitating the insertion of the sheets into the introduction channel and the retraction of these guiding elements and of these loading stops, during the travel of the top sheet towards the printing head, and fourth cams arranged so as to control the forward movement of the movable urging members under the effect of resilient members for the travel of the selected top sheet and the retraction of these members against the effect of said resilient members when the travel of the selected top sheet is completed.

This construction ensures a control of all the movable members which is simple and accurate, while needing only little space.

BRIEF DESCRIPTION OF THE DRAWINGS

Other advantages will become apparent from the characteristic features set forth in the depending claims and from the following detailed description of the invention, made in connection with the drawings which depict one embodiment, schematically and by way of example.

DETAILED DESCRIPTION OF THE INVENTION

Figure 1:
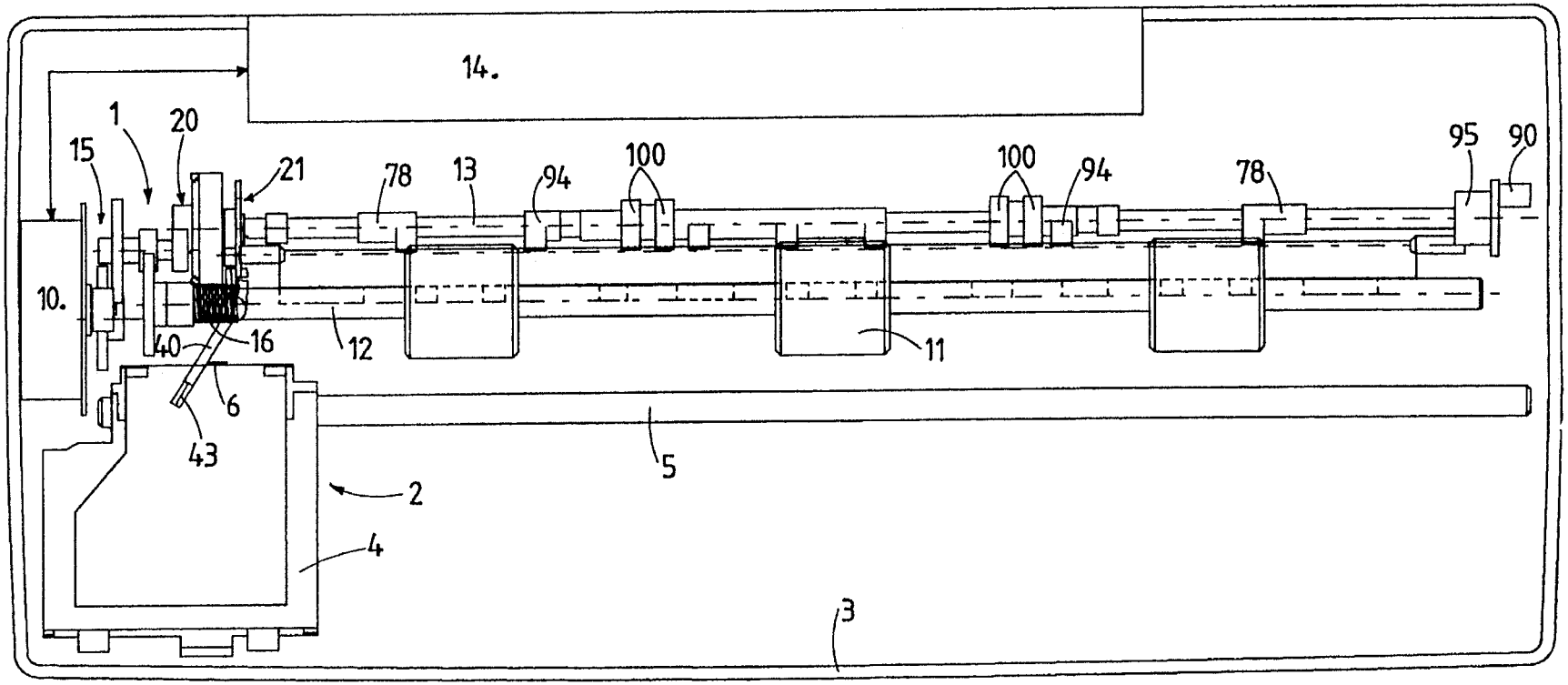
FIG. 1 is a top view of this embodiment incorporated into a printer, the portion shown in FIG. 2 being removed for sake of clarity.

The introduction device i illustrated partly in FIG. 1 is associated with a printer 2 including a frame 3, a traveller 4 sliding along a rod 5 and including a printing head 6. The frame could of course further include other components, such as a keyboard and a microprocessor.

The introduction device has a bidirectional electrical driving motor 10, which can be of the stepping type. This motor drives, on the one hand, driving rollers 11 locked with a driving shaft 12 and, on the other hand, a control shaft 13 which controls the movement of the different moving elements of the introduction device.

Figure 5:
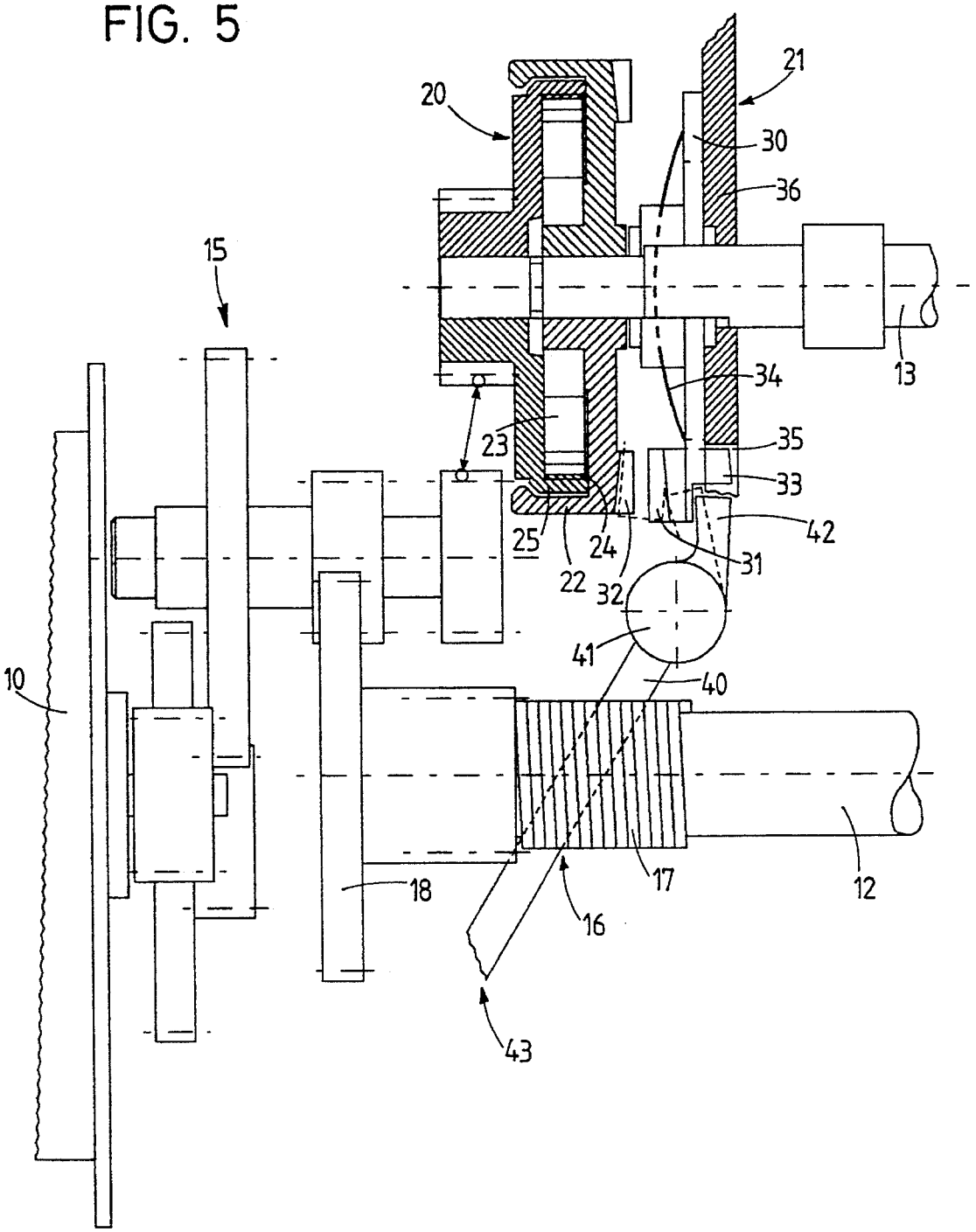
FIG. 5 is an enlarged view of a portion of FIG. 1.

Referring to FIGS. 1 and 5, motor 10 is connected through a train of gears 15 to a first unidirectional coupling 16 which is arranged in such a manner as to engage the driving shaft 12 when the motor 10 rotates in a first direction. This first unidirectional coupling 16 is of the so-called "torpedo" type and includes a helical spring 17 which is fastened to the gear 18 and which winds tightly around shaft 12, when the motor 10 rotates in the first direction, whereas the spring does not wind tightly around the shaft 12, in the opposite direction of rotation. The starting and the direction of rotation of the motor are controlled by a control unit 14.

Figure 6:
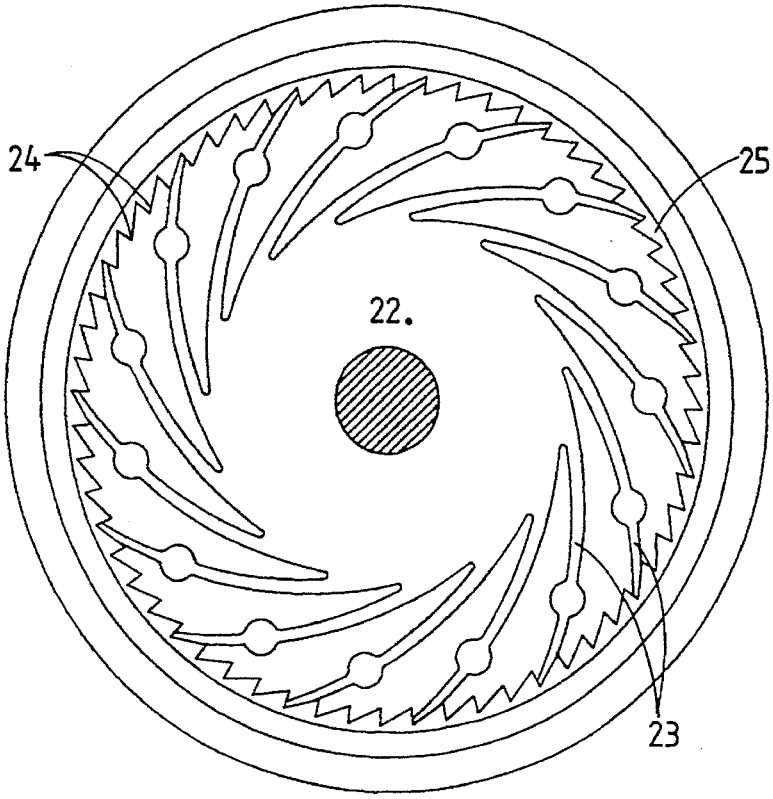
FIG. 6 is a cross-sectional view of a unidirectional coupling.

The train of gears 15 is equally arranged for cooperating with the control shaft 13 through a second unidirectional coupling 20 and a clutch device 21. This coupling and clutch device are shown in FIG. 5 shifted upwards for sake of clarity. The unidirectional coupling 20 includes a wheel 22 provided with a series of curved blades 23 cooperating at their ends with the gear teeth 24 of a coaxial wheel 25 engaged with the train of gears 15. Wheel 22 is driven when the motor 10 rotates in the second direction, i.e. when wheel 25 rotates in the counter-clockwise direction in FIG. 6.

The clutch device 21 consists of a disk 30 locked in rotation with the control shaft 13. This disk includes gear teeth 31 designed for cooperating in the engaged position with a corresponding gear teeth 32 forming part of the wheel 22 of the second unidirectional coupling 20.

It further carries a pin 33 which, in the disengaged position such as shown in full lines in FIG. 5, is urged by a leaf spring 34 into an opening 35 provided in the fixed wall 36 which is part of the frame 2. A lever 40 mounted rotatably on the frame by means of an axis 41 cooperates by one of its ends 42 with the disk 30 for disengaging the pin 33 from the opening 35 and for engaging the two sets of gear teeth 31 and 32, against the action of the spring 34, as shown in dotted lines in FIG. 5. When the motor 10 rotates in said second direction, the wheel 22 drives the disk 30, which in turn drives the control shaft 13 controlling, during a full revolution, the movement of the different movable elements of the introduction device. After completion of a revolution, the pin 33 sliding against the wall 36 falls again into the opening 35 owing to the action of the spring 34 and the shaft 13 is thus disengaged from the wheel 22 and the motor 10.

To control the introduction of a sheet, the lever 40 cooperates at its end 43 with the movable traveller 4 when the latter is in a predetermined position at the left-hand end of the printer. Clearly, the clutch can also be controlled by any other manual or automatic device.

Figure 2:
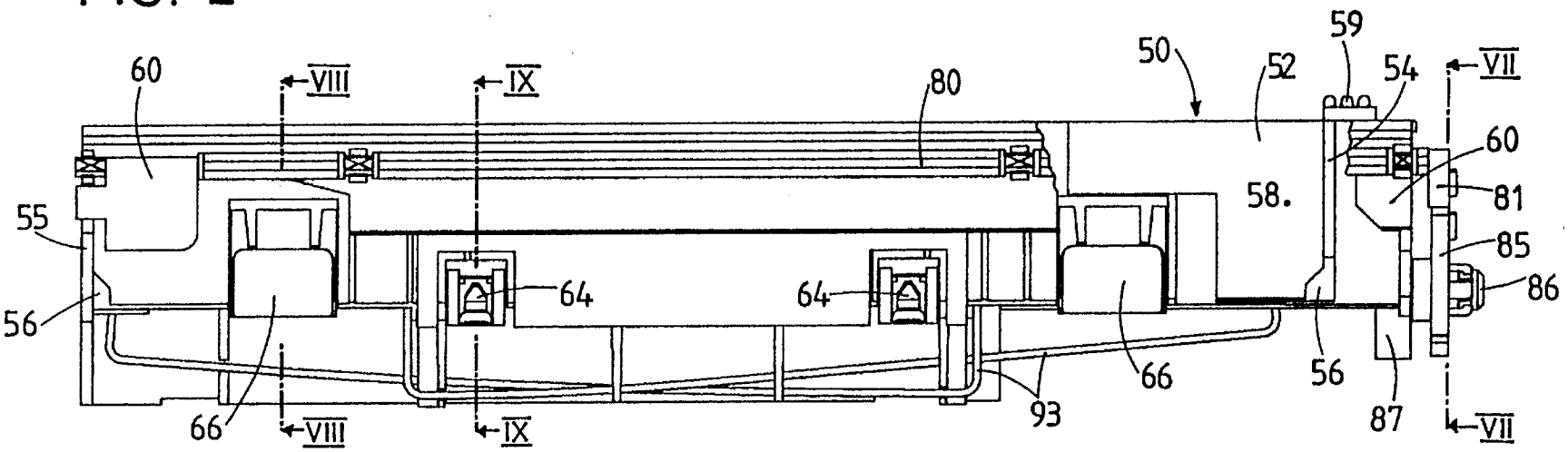
FIG. 2 is a view of the top face of a portion of the embodiment.
Figure 3:
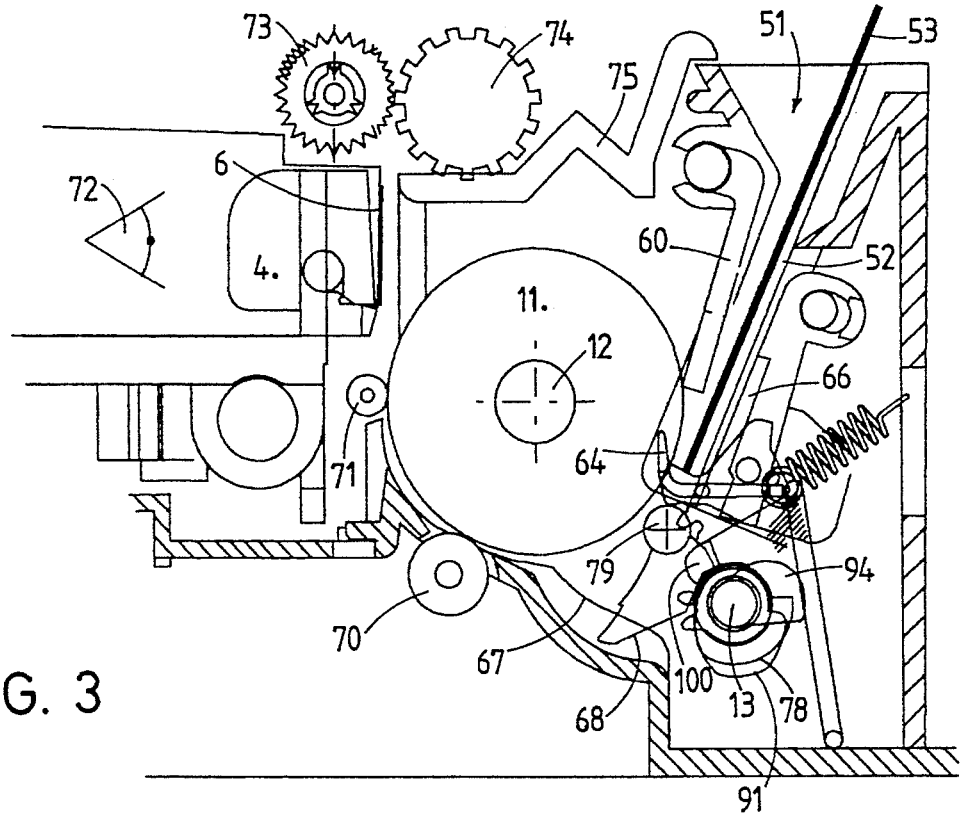
FIG. 3 is a cross-sectional view of the device in its non-operative position.
Figure 4:
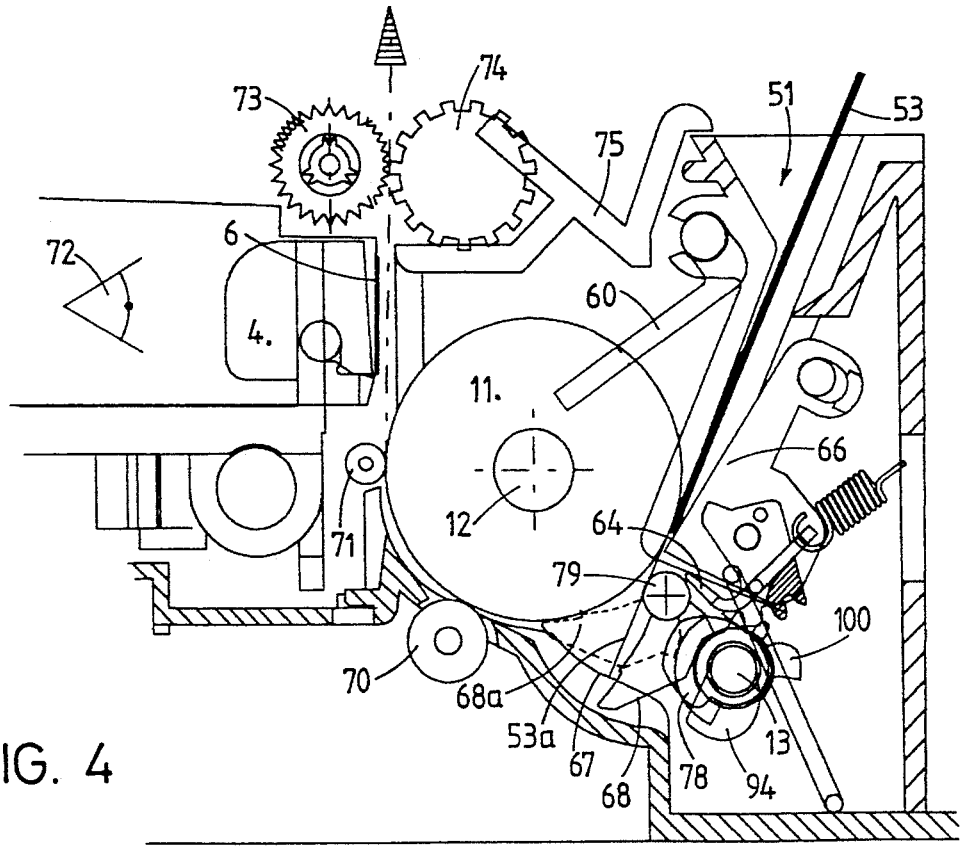
FIG. 4 is a cross-sectional view of the device in its operative position.

FIGS. 3 and 4 show in cross-section the different movable elements in the non-operative and in the operative positions. The unit assembly 50, shown separately in FIG. 2, is mounted on the introduction device to form an introduction channel 51 for the sheets with a support 52 provided for retaining a stack of sheets 53. This support 52 includes lateral guides 54, 55 (FIG. 2) with lower retaining corners 56 designed for cooperating with the lower corners of the sheets. The lateral guide 54 on the right-hand side of FIG. 2 is locked with a movable slide 58 which can be moved laterally by an adjustment button 59, for adapting the lateral guides to the paper format.

The introduction channel 51 further includes movable retractable guiding elements 60 in the form of controlled blades, capable of engagement in the introduction channel 51 for directing the sheets towards the retaining corners 56 during the insertion of a stack of sheets into the introduction channel (see FIG. 3). These guiding elements 60 are pivoted out of the channel 51 during the selection of a sheet (see FIG. 4).

In its median part, the support 52 for the sheets is provided at its lower edge with movable retractable loading stops 64 which can protrude in the introduction channel 51 for retaining a stack of sheets upon insertion (see FIG. 3). This is particularly useful, when the sheets are of a format which is too small to be retained by the corners 56. These loading stops are retracted (see FIG. 4) during the travel of the top sheet **53*a*** towards the printing head.

The support 52 is further provided with movable urging members 66 in the form of shoes acting to urge the sheets against the driving rollers 11 when the top sheet **53*a* (FIG. 4) is to be selected and brought to face the printing head 6. These movable urging members 66 are retracted from the channel 51** to avoid the selection of the following sheet and to allow an easy positioning of the stack of sheets of paper upon its insertion into the channel.

In its downstream part, the introduction channel includes a fixed alignment stop 67 formed of a part integral with the frame of the introduction device. This stop 67 is arranged in such a manner that during the first step of driving the top sheet 53a by the driving rollers 11, this sheet is urged by its front edge against this stop 67 to obtain an accurate alignment.

In this downstream part of the introduction channel 51, there are further provided deflector elements 68 which are retracted into the non-operative position in the first step of the selection of the top sheet **53*a* (see FIGS. 3 and 4, in full lines). In a second step, these deflector elements 68 are pivoted in such a manner as to cooperate with the top sheet 53*a* to remove its front edge away from the alignment stop 67 and to bring this edge to the driving rollers 11 in such a manner that this top sheet 53*a* comes in contact with the periphery of these rollers, as shown by the dotted lines 68*a* in FIG. 4**.

The sheet **52*a* is then pressed against the driving rollers 11 and when the latter are set into rotation in the clockwise direction in FIG. 4, the sheet travels between the counter pressure rollers 70, 71 and the driving rollers 11 and past the printing head 6 to be brought facing an optoelectronic sensor 72**, which controls the stopping of the driving of the sheet in the position which corresponds to the first line of print.

The printed sheet is then carried by the two wheels 73, 74 engaged with the motor 10, of which one 73 has gear teeth and the other 74 a series of notches. The latter are arranged in such a manner as to act upon the rear edge of the printed sheet to lift the same and carry it away to be deposited in a receiver 75 for printed sheets.

The movements of all the movable elements provided in the introduction channel 51, i.e. the deflector elements 68, the movable retractable guiding elements 60, the movable loading stops 64 and the movable urging members 66 are controlled by cams associated with the control shaft 13.

As can be seen in FIGS. 3 and 4, the control shaft 13 has first cams 78 designed for cooperating with the deflector elements 68 to move the same from a retracted position to an operative position and vice versa, by rotation around the axis 79.

Figure 7:
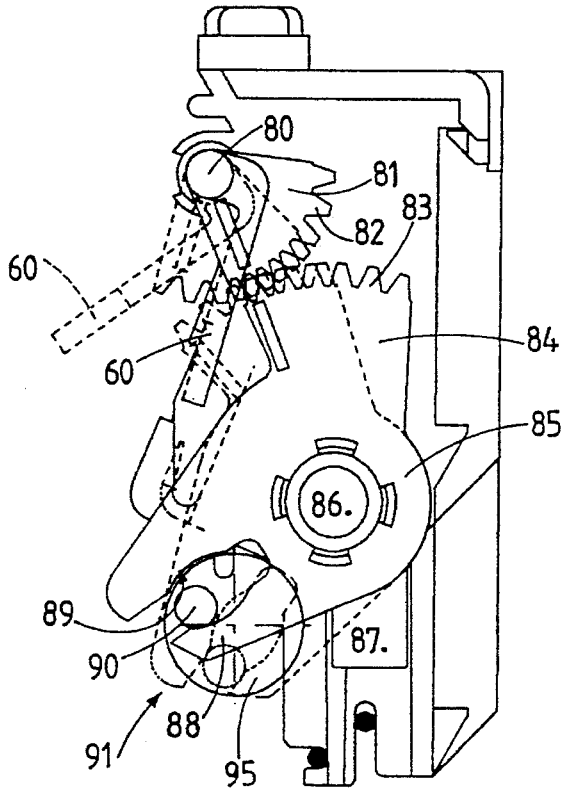
FIGS. 7, 8 and 9 are cross-sectional views taken along lines VII—VII, VIII—VIII and IX—IX of FIG. 2.

The control mechanism of the movable retractable guiding elements 60 is explained in more detail with reference to FIGS. 7 and 2. These guiding elements 60 are rotatable about a shaft 80 which is integral with a sector 81 carrying gear teeth 82 which cooperate with the gear teeth 83 provided at the end of a first arm 84 of a lever 85. The latter is rotatable about an axis 86 on the frame 87 of the unit assembly 50 and includes a second arm 88 having a shaped slot 89 arranged so as to cooperate with a finger 90 carried by the plate 95 integral with the control shaft 13 (see FIG. 1). The assembly consisting of the slot 89, the finger 90 and the plate 95 thus forms a cam mechanism 91. Accordingly, during a rotation of the shaft 13, the lever 85, the sector 81 and the guiding elements 60 are pivoted from the non-operative position shown in full lines of FIG. 7 to the retracted position shown in dotted lines. They return thereafter to their non-operative position in which the guiding elements 60 are engaged in the introduction channel 51.

Figure 8:
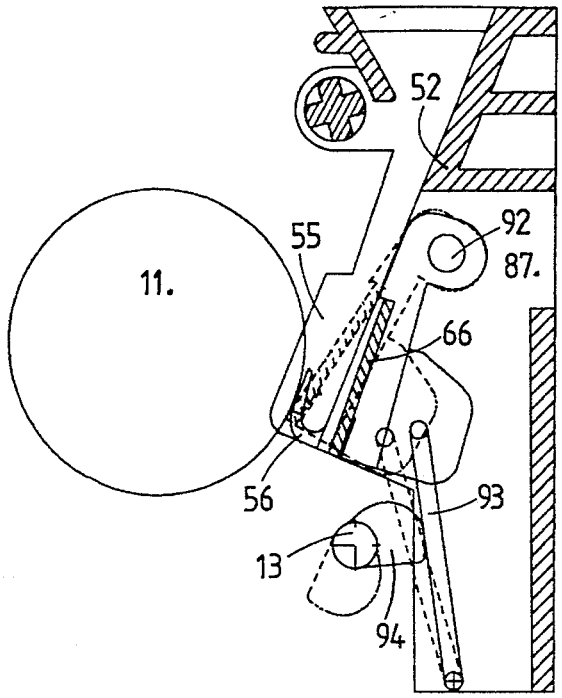

Referring to FIGS. 8 and 2, the urging members 66 are rotatable with respect to the frame 87, owing to the axes 92. Two springs 93 with resilient metal leafs push the urging members 66 into their operative position shown in dotted lines in FIG. 8, in which they press the sheets against the driving rollers 11. Third cams 94 cooperate with the springs 93 to move the urging members 66 towards their retracted position shown in full lines in FIG. 8, to allow the positioning of a stack of sheets on the support 52. In FIG. 8, there is also shown one of the fixed retaining corners 56 integral with the lateral guide 55 and which has a rounded internal shape to facilitate the removal of the top sheet 53*a* upon its selection.

Figure 9:
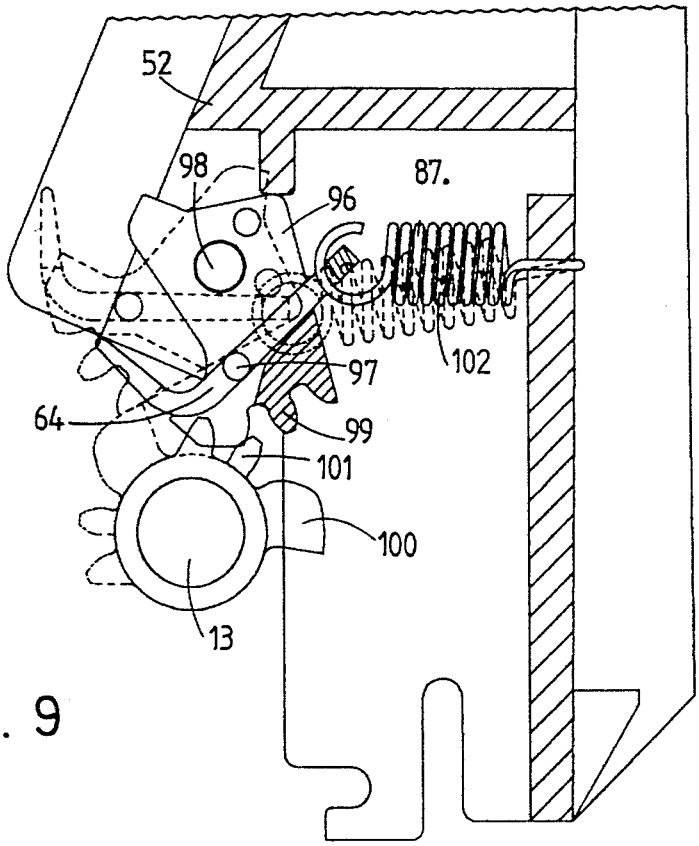

The control mechanism of the loading stops 64 is explained in more detail with reference to FIG. 9. These movable stops 64 are mounted pivotally on a stirrup-shaped part 96 by means of an axis 97. The stirrup-shaped part 96 is also pivotally mounted on the frame 87 by means of an axis 98 and includes at its lower end gear teeth 99 designed for cooperating with a cam 100 integral with the control shaft 13 and which also exhibits gear teeth 101. A helical spring 102 connects the rear part of the loading stops 64 to the frame 87 and urges these stops to the position in which they are retracted from the introduction channel 51. By rotation of the control shaft 13, the cam 100, the part 96 and the loading stops 64 are brought to the position shown in dotted lines in FIG. 9, where they retain the sheets on the support 52. An additional rotation of the control shaft 13 releases the mechanism which returns to the position shown in full lines in FIG. 9.

The functioning of this introduction device is as follows. In the non-operative position, in which a stack of sheets can be placed on the support 52, such as shown in FIG. 3, the guiding elements 60 and the loading stops 64 are in their operative position. The urging members 66 and the deflector elements 68 are in their retracted position. Following an order to introduce paper, the lever 40 causes the engagement of the clutch device 21. The motor 10 then proceeds in a first step to a rotation in the second direction to drive in rotation the control shaft 13 by a predetermined angle such that the urging members 66 urge the sheets 53 against the driving rollers 11 and that the guiding elements 60 and the loading stops 64 be retracted. In a second step, the direction of the motor 10 is reversed, to drive in rotation the driving rollers 11 which release the top sheet 53*a* from the retaining corners 56 and move the same downwards to urge its front edge against the alignment stop 67. A small additional distance is travelled at this moment so as to ensure by pressure an accurate alignment of the sheet 53*a*. During the third step, the motor 10 rotates in the second direction and the control shaft 13 causes, through the action of the cams 78, the forward movement of the deflector elements 68 which urge the top sheet 53*a* against the driving rollers 11 (FIG. 4). In a fourth step, the motor 10 rotating in the first direction drives the sheet to the printing head 6 and to the optoelectronic sensor 72 which notes accurately its passage. In the fifth step, the rotation of the motor in the second direction causes the retraction of the urging members 66 and of the deflector elements 68, through the action of the cams 94 and 78, and the forward movement of the guiding elements 60 and of the loading stops 64, through the action of the cams 91 and 100. Finally, in a sixth step, the motor 10 rotates in the first direction to drive the sheet 53*a* to face the printing head.

At the end of the printing, the sheet is carried by the wheels 73, 74 engaged with the motor 10 rotating in the first direction, to be deposited in the receiver 75.

This construction ensures a conveying of the paper which is reliable and also an accurate alignment of the sheet to be printed, while making it possible to reduce considerably the space needed by the device. Another advantage results from the fact that the manufacture and the assembling of the device are simplified, since the movable elements associated with the paper support 52 and with the introduction channel 51 thereof are arranged on a separate unit assembly 50 (FIG. 2). The assembling of this unit 50 is carried out separately and the assembled unit 50 can then be placed on the frame 3 including the motor 10 and the driving and control shafts 12, 13 with their ancillary elements such as illustrated in FIG. 1. This construction also facilitates repairs or enables a rapid exchange of the unit assembly 50.

Clearly, the embodiment described above is not intended to be limiting in any manner and it can receive all the modifications desirable within the framework defined by claim 1. In particular, certain elements, such as the loading stops 64 or the guiding elements 60 can be deleted in simplified versions. The movable urging members 66 can be replaced by a movable sheet support which can be moved or pivoted to apply the sheets resiliently against the driving rollers 11 during the selection. These rollers may be replaced by a typewriter or a printer cylinder. The rotation of the driving shaft 12 and of the control shaft 13 can also be provided for by two separate motors.

We claim:

1. A device for introducing sheets into printers or typewriters, comprising an introduction channel having a support for retaining a stack of sheets, driving rollers mounted on a driving shaft for moving a top sheet of the stack and for bringing said top sheet to face a printing head, a fixed alignment stop positioned downstream of the introduction channel, means for urging the top sheet by its front edge against said alignment stop, and at least one movable deflector element cooperating with said top sheet for removing said front edge of said top sheet from the alignment stop, and for bringing said edge to the driving rollers, whereby the top sheet comes in contact with the periphery of the driving rollers.

2. A device according to claim 1, wherein said introduction channel further includes movable retractable guiding elements for guiding the sheets into retaining corners of the support during insertion of the stack of sheets into the introduction channel.

3. A device according to claim 2, wherein the support is provided with movable urging members for urging the sheets against the driving rollers by the action of leaf springs when the top sheet of the stack is to be selected and brought to face the printing head.

4. A device according to claim 3, wherein the support further includes movable retractable loading stops which protrude into the introduction channel for retaining the stack of sheets during said insertion into the introduction channel, and which retract during movement of the top sheet towards the printing head.

5. A device according to claim 4, further comprising a control shaft lying parallel to the driving shaft of the rollers and carrying first cams for controlling the movement of the movable deflector element.

6. A device according to claim 5, wherein the driving shaft and the control shaft are connected to a single motor adapted to rotate in two directions, the driving shaft being provided with a unidirectional coupling for engaging with the motor in a first direction of rotation, and the control shaft being provided with a second unidirectional coupling for engaging with the motor in the second direction of rotation.

7. A device according to claim 6, wherein the control shaft further includes second and third cams for controlling the movement of the movable retractable guiding elements and of the movable retractable loading stops, respectively, into the introduction channel for facilitating the insertion of the stack of sheets into the introduction channel and the retraction of the guiding elements and the loading stops, during travel of the top sheet towards the printing head, and fourth cams for controlling the movement of the movable urging members under the effect of said leaf springs for the travel of the selected top sheet, and the retraction of said urging members against the action of said leaf springs when the travel of the selected top sheet is completed.

8. A device according to claim 7, further comprising control members for producing during a travel cycle of the top sheet towards the printing head:

in a first step of the cycle, a rotation of the motor in said second direction to impart a forward movement to the urging members through the action of the fourth cams, to urge the top sheet against the driving rollers and bring about the retraction of the guiding elements and of the loading stops through the action of the second and third cams;

in a second step of the cycle, a rotation in the first direction to drive the rollers and move the top sheet so as to urge the front edge of said top sheet against the alignment stop;

in a third step of the cycle, a rotation in the second direction to impart, through the action of the first cams, a forward movement to the deflector element for urging the top sheet against the driving rollers;

in a fourth step of the cycle, a rotation in the first direction to drive the top sheet up to the printing head;

in a fifth step of the cycle, a rotation in the second direction to bring about the retraction of the urging members and the deflector element, through the action of the fourth and fifth cams, and the forward movement of the guiding elements and of the loading stops, through the action of the second and third cams; and in a sixth step of the cycle, a rotation in the first direction to drive the top sheet beneath the printing head.

9. A device according to claim 6, further comprising a clutch device for establishing driving contact between the second unidirectional coupling and the control shaft, following an actuation command, said clutch device being positioned between the second unidirectional coupling and the control shaft.

10. A device according to claim 6, wherein the second unidirectional coupling device includes a first wheel with curved blades having outer portions which cooperate with the teeth of a geared wheel surrounding the first wheel.

11. A device according to claim 4, wherein the deflector element, the guiding elements, the loading stops and the urging members are mounted on a separate assembly, said assembly adapted to be mounted as a single unit on the device.

12. A device according to claim 1, further comprising conveyor elements positioned downstream of the printing head and formed as profiled wheels for acting upon a rear edge of a printed sheet to lift and carry said printed sheet to a receiver for printed sheets.

13. A device according to claim 1, further comprising detection means for detecting the passage of a sheet and for ensuring accurate positioning of the sheet to be printed.

* * * * *